US007077758B2

(12) United States Patent
Rohrer

(10) Patent No.: US 7,077,758 B2
(45) **Date of Patent: *Jul. 18, 2006**

(54) GOLF PUTTER WITH IMPROVED MOMENT OF INERTIA, AIM AND FEEL

(75) Inventor: John W. Rohrer, York, ME (US)

(73) Assignee: Rohrer Technologies, Inc., York, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/170,982

(22) Filed: Jun. 30, 2005

(65) Prior Publication Data

US 2005/0239574 A1 Oct. 27, 2005

Related U.S. Application Data

(63) Continuation-in-part of application No. 10/165,435, filed on Jun. 7, 2002, now Pat. No. 6,958,019.

(51) Int. Cl.
*A63B 53/04* (2006.01)
*A63B 69/36* (2006.01)

(52) U.S. Cl. ..... 473/251; 473/324; 473/345; 473/349; 473/340

(58) Field of Classification Search ..... 473/324–350, 473/251–255, 313–314
See application file for complete search history.

(56) References Cited

U.S. PATENT DOCUMENTS

| | | | | |
|---|---|---|---|---|
| 4,010,958 | A * | 3/1977 | Long | 473/341 |
| 4,253,667 | A * | 3/1981 | Clark et al. | 473/325 |
| 4,754,976 | A * | 7/1988 | Pelz | 473/340 |
| 4,815,739 | A * | 3/1989 | Donica | 473/313 |
| 5,072,941 | A * | 12/1991 | Klein | 473/255 |
| 5,080,365 | A * | 1/1992 | Winchell | 473/255 |
| 6,017,280 | A * | 1/2000 | Hubert | 473/324 |
| 6,506,125 | B1 * | 1/2003 | Helmstetter et al. | 473/242 |
| 6,958,019 | B1 * | 10/2005 | Rohrer | 473/324 |

* cited by examiner

*Primary Examiner*—Sebastiano Passaniti
(74) *Attorney, Agent, or Firm*—Preti Flaherty

(57) ABSTRACT

A golf putter in which most of the clubhead mass is distributed at three or more individual or one or more arcuate locations within a "Mass Ring" approximately equidistant from, and as remote as possible from, the clubhead planar center of mass with the clubshaft axis preferably forward of the clubhead center of mass thus maximizing both putter and clubhead planar moment of inertia for improved putter performance during mis-hits. Maximum remote mass is achieved by interconnecting the remote high mass areas (Mass Ring) with the putterface striking area and the putter shaft connection point with a light weight rigid open (see thru) truss system so arranged to enhance the visibility of the Sighting Field and/or aim or Sight Line on the putterhead while preventing undesirable vibration of individual clubhead members.

16 Claims, 8 Drawing Sheets

(Toe - Heel Bi-Polar Weighting)

(Fore - Aft Bi-Polar Weighting)

Rohrer vs. Long (Prior Art)
Mass Distribution

Examples of "Elongated Siting Field with Pronounced Elongated Site Line"

Striped Rectangle

Striped Bullet

Striped Oval

Striped Rectangle / Circle

Striped Multi-circle

Striped Multi-rectangle

Double Bulls Eye

Double Diamond

Diamond Circle

Long Diamond

Long Hexagon

Hexagon Circle

Arrow

GOLF PUTTER WITH IMPROVED MOMENT OF INERTIA, AIM AND FEEL

CROSS REFERENCE TO RELATED APPLICATIONS

This application is a Continuation-in-Part of U.S. patent application Ser. No. 10/165,435, entitled "GOLF PUTTER WITH IMPROVED MISS-HIT PERFORMANCE, AIM AND FEEL" and filed Jun. 7, 2002; Now U.S. Pat. No. 6,958,019.

BACKGROUND OF THE INVENTION

The present invention relates to golf clubs and more particularly to putters. Superior putters are characterized by repeatable accurate sighting or aim, good forgiving performance on miss-hits, and a solid feel communicated to the hands upon impact with a golf ball.

Historically, most putters, being of the blade type, derived from irons, require the player to draw or imagine an aim line to the target, through the ball at right angles to the putterface. Some putters, especially mallet types, have one or more relatively short axially oriented (target line) Sight Lines, but they are visually overwhelmed by the larger transverse oriented putterface and the transverse putterhead lines. Axial sighting or aim is also effectively blocked by the golf ball in front of the putterface.

Forgiving performance is a major objective of most modern putter designers, especially those targeting non-professional players. Even if a clubhead is delivered square to the target line at impact, a golf ball will lose both distance and accuracy (i.e., go off line) if the ball is not struck precisely on an axis in front of the putter planar center of mass. The degree of distance loss and mis-direction from a particular miss-hit is directly related to the putter planar moment of inertia ("MOIP"). This is determined by the clubhead or putterhead planar moment of inertia ("MOICH") and the position of the shaft in the putterhead which shaft weight and the shaft's own axial moment of inertia ("MOI") contributes to the putter MOI. The higher the MOIP, the less the distance loss and angular misdirection for a given miss-hit. Putters typically have 9 to 18 cm facewidths with head weights of 280 to 350 gms and have MOIP of 2000–8000 gm $cm^2$. (Long shafted putters are heavier). Putters typically produce 2% to 8% of distance loss with a 1 cm toe or heel miss-hit.

"Solid feel" is a more subjective term, but most golfers agree, undamped vibrations from center hits (on center of mass line) are helpful in establishing a feel for putt distance vs. putterhead striking velocity. Excessive strike face, or other putterhead interval vibration, is undesirable for putters and other clubs, and is traditionally eliminated through clubhead geometry (thick strike faces reinforced with bottom flanges or solid mallet type bodies). Harsh torsional vibrations from miss-hit putts are undesirable and can be reduced by increasing putter MOI or vibration dampening elastomers in or behind the strike face.

Toe-heel weighted putters (transverse bi-polar weighted) are the most popular type in current use, largely replacing traditional "blade" styles. Extreme bi-polar weighting such as that by Finney (U.S. Pat. No. 4,898,387), McGeeney (U.S. Pat. No. 5,938,543), Long (U.S. Pat. No. 4,693,478), and Duclos (U.S. Pat. No. 4,508,350), have produced designs with MOIP up to 8300 gm-$cm^2$ for conventional sized putters (less than 13 cm facewidth and about 320 gms head weight). They are typically characterized by short or no axial alignment features. Sighting Fields are defined herein as axially oriented, usually light, bright, or white colored, areas roughly the width of a golf ball, on top of a putter which reduce the visual blocking effect on aim of a ball in front of a putterface. Sight Lines herein refer to axial lines, dots or points on top of a putter through the intended strikepoint or parallel to it and normal to the strikeface, to assist or facilitate axial (ball to target) "aim" or "sighting." Axial bi-polar weighted (fore and aft weighted) designs (i.e. Winchall U.S. Pat. No. 5,080,365, and Pelz U.S. Pat. No. 4,754,976) have better sighting characteristics, but no better MOICH because a 13 cm putterhead width must have 13 cm or less of depth to conform to current USGA Rules.

FIGS. 1–4 compare prior art idealized theoretical maximum MOICH for transverse bi-polar or toe-heel weighted (FIG. 1) axial bi-polar (FIG. 2), and the present invention (FIGS. 3 and 4). All four theoretical putterheads have a 12.7 cm (5 in.) facewidth, weigh 300 gms (with weightless frames) and are USGA conforming dimensionally. The maximum theoretical planar MOICH for each using MOICH (I)=Mass (M)×(radius of gyration (r))$^2$ is:

a. Transverse Bi-polar (FIG. 1) 12097 g-$cm^2$
b. Axial Bi-polar (FIG. 2) 12097 g-$cm^2$
c. Present invention tri-polar Mass Ring (FIG. 3) 18901 g-$cm^2$
d. Present invention Multi-polar Mass Ring (FIG. 4) 23710 g-$cm^2$ In preferred embodiments of the present invention, putter moment of inertia (MOIP) exceeds the MOICH values above because the shaft axis is substantially forward of the center of mass.

Putters with elongated (over 75% of facewidth) axial Sighting Fields or Sight Lines are less common, but do exist. Current examples include, Callaway's White Hot "2-Ball" putter, Golf Digest, 3–02, Pg. 159 (a derivative of Pelz U.S. Pat. No. 4,754,976), as well as, Winchall U.S. Pat. No. 5,080,365, and other T-shaped putters cited (Klein U.S. Pat. No. 5,072,941, Panlin U.S. Pat. No. 4,141,556, Dalton U.S. Pat. No. 4,138,117, Bendo U.S. Pat. No. 5,470,070, Lin U.S. Pat. No. 5,795,239, Jenkins U.S. Pat. No. 6,045,453, Whitney D U.S. Pat. No. 323,688, Lannoch D U.S. Pat. No. 422,328). None of these maximizes either MOICH or MOIP. The present invention maximizes both. Most of these utilize a "Sight Line" (an elongated line less than 1 cm wide through the intended strike point). Few (only Pelz and Klein) use an axial Sighting Field (but no Sight Line). Again, only the present invention combines a Sighting Field with maximum MOICH and MOIP. Only one Sight Field putter (U.S. Pat. No. 4,962,293 to Jazdzyk) other than the present invention attempts to take all components outside the Sighting Field or Sight Line out of planar view, but this design does not address MOI and uses a transparent/translucent putterhead material, thus not conforming to USGA rulings. The present invention uses a high open area rigid putterhead frame and dark non-reflective planar coloration outside the Sighting Field or Sight Line.

DISCUSSION OF THE PRIOR ART

U.S. Pat. No. 4,010,958 to Long discloses a putter with a square clubhead with a majority of the clubhead mass disposed at the four corners and the club shaft axis connected through the clubhead center of gravity. FIG. 5 compares Long '958 with the present invention, both with the same clubhead mass and same facewidth and maximum dimension. This comparison shows that the Mass Ring weighted putterhead of the present invention will have substantially higher clubhead MOI (MOICH). When clubface width of both is 5 inches (12.7 cm) and the frame thickness is 1.6 mm, MOICH of the present invention exceeds Long '958 by over 34%.

The present invention gains substantial additional MOIP over Long '958 by placing the shaft axis substantially forward of the clubhead center of mass. A putter shaft and grip typically weigh about half as much as a putterhead, which averages about 320 gms for traditional length putters. The grip and shaft add very little MOIP if the shaft axis goes through the clubhead center of mass like Long '958 (perhaps 50 to 100 gm $cm^2$ depending on grip and shaft diameter). With the shaft axis 8 cm in front of the putter center of mass, typical of a preferred embodiment of the present invention, the additional MOIP contributed by the shaft and grip rotating around the putter center of mass is about 1750 gm $cm^2$, an added 10.6% improvement over Long '958. The present invention requires less framing than Long because the cylindrical "Mass Ring" weighting sections of the putterhead can also serve as a major part of the frame and such cylindrical sections are inherently rigid (arch principle). Long's putter also suffers from poor Sight Fields and Sight Lines.

U.S. Patent No. 4,754,976 to Pelz discloses a putter with an elongated depth along the target axis with a center of mass 10 cm or more behind the striking face and shaft axis. Pelz calculates an impressive MOIP of 20,200 gm $cm^2$ with the center of mass 10.5 cm behind the striking face. To calculate this very high MOIP, Pelz incorrectly assumes that the putterhead (aprox. 320 gms) upon impact with a ball (45 gms) rotates about the ball impact point. In actuality, the putter and putterhead upon impact rotates about the putter center of mass. To verify this, two T-shaped putters were constructed and tested. Both had a 30 gm hard wood rigid frame with the same face width and 300 gms of lead weights, all weights were located 10.5 cm from the strike face for Pelz (and 3 100 gm weights at "T" ends of a Mass Ring in present invention model). When tested in a trigger release frictionless true pendulum putting machine producing identical repeatable impact velocity, both produced 18 ft rolls with center hits. With 2 cm toe or heal miss-hits, the Pelz configuration, however, lost 11% distance (and 5° misdirection) while the present invention tri-polar Mass Ring configuration had less than 25% of this distance loss and misdirection even though weight distribution for the present invention was not optimized for highest possible MOIP. Based on prior testing of other putters, the Pelz test performance indicated an MOIP below 5000 gm $cm^2$. Placing the clubhead center of mass 10 cm or more behind the strikepoint prevents attainment of maximum MOICH and MOIP unless the putter depth exceeds 20 cm (twice normal size).

U.S. Pat. No. 5,080,365 to Winchell discloses a T-shaped putter like Pelz '976 (but not cited in '976) and others, with fore and aft weighting (like Long '958), high polar moment of inertia to mass ratio (like Long '958), a rigid striking face (like all good commercial putters), and "nearly equal yaw and pitch moments of inertia" (like Long '958, commercial mallet heads, and other fore and aft weighted designs). His longitudinal bi-polar design ('365 FIG. 2) and his tri-polar design ('365 FIGS. 4 and 5), will always have lower MOICH than the present invention tri-polar design. Tri-polar MOICH always exceeds bi-polar MOICH of the same weight, putterhead width, and depth (about equal under USGA rules) because tri-polar r in $MOI=mr^2$ is always greater. Winchell's tri-polar design will always have a lower MOICH than the Mass Ring weighted tri-polar design of the present invention (FIG. 3) because Winchell co-locates the center of mass, pitch and yaw neutral axis, and the geometric center, such that his yaw and pitch polar moments are equal. The tri-polar design of the present invention maximizes MOICH (which '365 calls "MOI yaw") by putting the three masses in the Mass Ring equidistant from the clubhead center of mass, placing the center of mass closer to the striking face than the rear mass and making the rear mass heavier than either front weight to keep it at the extremity of the Mass Ring, but not twice as heavy like '365. '365 places the center of mass midway between the striking face and rear weight (for equal pitch MOI). This will always produce lower planar or yaw MOI.

The present invention is, of course, not limited to circular or round putterheads, but rather putterheads where the majority of weight is located approximately equidistant from the clubhead center of mass within a planar ring, hollow cylinder, or "Mass Ring" with an outside diameter approximately concentric with (i.e. excluding sharp corners or projections of little mass) the maximum planar putterhead dimension and an inside diameter at least 70% of the outside diameter in preferred embodiments. Many others have previously proposed and used circular shaped putterheads. Many, perhaps most, "mallet head" putters are somewhat circular or semi-circular in shape. Some have toe-heel weighting with or without additional aft weights. Most woods and metal woods are of somewhat circular plan. Several metal woods (McHenry Titanium Driver, Wilson Deep Red 365 cc Driver, and recent Callaway "C4 Driver") use circumference (perimeter) weights to increase clubhead MOI slightly, but these designs still have a minor portion of the clubhead weight located outside 70% of the maximum planar dimension (diameter) and not in a Mass Ring approximately concentric about the planar center of mass. Woods need rugged sole plates for durability and cannot have interior openings under USGA rules, thus limiting circumference weighting. U.S. Pat. No. 5,993,330 to Akerstrom discloses a disc shaped putterhead with an alignment stripe. The putterhead does not conform to current USGA's Rules of Golf because the clubface width does not exceed ⅔ clubhead depth. The putterhead also lacks an open rigid interior frame and lacks a majority of its weight within a planar ring (the Mass Ring) exceeding 70% of the maximum putterhead dimension.

U.S. Pat. No. 4,815,739 to Donica discloses a semi-circular putterhead with a plurality of spokes therefrom connecting the shaft which assembly is "disjoined" from the faceplate for the purpose of "an enlarged sweet spot." This disjoinment does not increase clubhead MOI and thus does not enlarge the "sweet spot." Unsupported (non-rigid) faceplates create very "unsweet" vibrations even on perfect strikes and are, therefore, unpopular in the art. The design also lacks the predominant circumferential weighting (Mass Ring) (the semi-circle is not concentric with the center of mass), the rigid open frame (no rigid connection to strike point) and the Sighting Field of several embodiments of the present invention.

SUMMARY OF THE INVENTION

The present invention discloses a golf club especially useful as a putter which: 1) maximizes clubhead planar moment of inertia (MOICH) for a given maximum clubhead dimension and clubhead weight and in preferred embodiments, overall club or putter planar moment of inertia (MOIP) by placing a majority of clubhead mass (in preferred embodiments over 70%) within one or more arcuate or three or more separate positions, approximately equidistant from the clubhead center of mass, and within a planar ring, the "Mass Ring", centered about the clubhead center of mass, the extremity or outside diameter of such ring, or other points of greatest width, approximately coincident with both ends of the putter striking face (excluding sharp corners which may be outside said mass ring) and the rear most positions of such putterhead, 2) provides the desirable high MOIP of 1) above along with enhanced feel by using rigid open truss members to put said majority of clubhead mass and the club shaft in rigid solid communication with the central portion of the clubhead strike face thus minimizing undesirable impact vibration within individual clubhead members. Undesirable torsional vibration from miss-hits are reduced due to the extremely high MOICH and MOIP relative to clubhead weight and maximum dimension, and 3) in some embodiments facilitates more accurate aim or sighting along the intended target line by using an elongated target line (axial) aligned Sighting Field, approximately the width of a golf ball and at least ⅔ as long as the facewidth, and/or a narrow axial Sight Line.

Extremity weighted tri-polar (3 weight) putterheads usually have higher MOICH and MOIP, and therefore better miss-hit performance than more common bi-polar (toe-heel weighted) putters for the reasons previously discussed. The subject invention has higher MOIP than prior art tri-polar putters (of the same putterhead width and head weighting) because the weights which represent most of the clubhead mass are approximately equidistant from the center of gravity and in a relatively narrow ring, the Mass Ring, concentric with it. This requires the rear weight to be approximately 19% heavier than either of the front two weights. Winchell '365, in the prior art, has the rear weight at 2 times either front weight resulting in lower MOICH.

Weighting at 4 or more individual positions equidistant from the center of gravity and in a relatively narrow concentric ring about it (within the Mass Ring of the present invention) results in even higher MOICH clubheads than tri-polar weighting (of same clubface size and weighting). The circle radius (r) intersecting the weights is larger hence higher $I=M\times r^2$. "I" is polar or planar moment of inertia (MOI) and "M" is mass. The MOICH of the present invention (Mass Ring with 4 or more weights) substantially exceeds that of the prior art (Long '958) because Long's weights are within his square exterior dimensions (the weights themselves are also square shaped in section) while the weighting of the present invention is mostly external to Long's square (and elongated or shaped like ring sections) per FIG. 5, again creating a much larger r (which is squared in $I=Mr^2$). Several embodiments of the present invention further exceeds Long via placing the shaft axis forward of the clubhead center of mass making MOIP substantially greater than MOICH (Long's MOICH and MOIP are almost identical). Long '958 places a "majority" of mass in his square corner boxes while preferred embodiments of the present invention place at least 70% of putterhead mass within the Mass Ring. Unlike Long's square weights, the weights or weighting means of some embodiments of the present invention are planar elongated with the longer dimension oriented roughly normal to a line connecting each weighting means to the putterhead planar center of mass.

The present invention achieves high MOICH by putting most of the clubhead mass into a relatively narrow ring, the Mass Ring, approximately concentric around the clubhead center of mass. Weight size and location are adjusted to keep this weighting ring or Mass Ring concentric. The clubhead interior to this Mass Ring is mostly open or void space which serves several purposes. Firstly, voids have no mass. Secondly, these void areas are not visible (you see green grass through the putterhead voids) thus allowing the golfer to better focus and aim with the axial Sighting Field or Sight Line. Because the Mass Ring of the present invention is relatively narrow, and preferably green or other dark dull color, it does not distract focus from aim down the Sighting Field and Sight Line. Likewise, those frame members rigidly and solidly connecting the weights to the putterface and shaft mount outside the Sight Line or Sighting Field, are thin in planar section, and likewise dull or dark colored. The same elements of the present invention, therefore, allowing maximum MOICH and MOIP, namely the Mass Ring supported by a rigid high open area, thin section, open (space) frame also provides superior putter aim or sighting. Should the USGA at any time allow dimensional changes or appendages on putterheads outside the Mass Ring diameter of the present invention (a circle approximately concentric with the center of mass approximately intersecting the toe and heel extremities of the faceplate, or other points of greatest width, and the rear most portions of the putterhead, excluding sharp corners or projections of small mass), then the Mass Ring diameter shall be extended and all other principles of the present invention shall apply.

Proper design of this high open area space frame produces a putterhead which feels solid (i.e., no vibration of internal weight or frame members). This is accomplished by using rigid straight members, rigid triangles, and/or rigid arches to interconnect the weights, putterface strike area, (center+/−2 cm) and the shaft connection (or hosel). This open space frame can be made of cast or fabricated metal open cell honeycomb, preferably triangular cell, with cell sizes down to 0.75 cm and metal thickness down to 0.5 mm or fewer triangular cells (like FIG. 5–8, 11–13) with faceplate and frame thickness to 5 mm.

Axial sighting or aim (down the target line) is superior to transverse sighting for most golfers. This is why pool players and fire arms shooters site down the pool cue or gun barrel rather than transverse to it. Most putterheads are shallow front to back vs. toe to heel with short ineffective or non-existent Sighting Fields and Sight Lines. The predominant optical lines of most putterheads are transverse (parallel to the strikeface), forcing the golfer to draw an imaginary 90° line from the intended strikepoint on the strikeface through the ball to the target. The ball optically blocks the Sight Line making aim even more difficult.

The present invention provides an elongated (preferably over ⅔ the clubface width) Sighting Field, approximately the width of a golf ball to overcome the visual blocking effects of a golf ball in front of the putterface. The golf ball then actually extends or lengthens the axial Sighting Field. This Sighting Field can be an integral part of the space frame (FIGS. 9 and 14) or attached above or below it.

The Sighting Field can be one solid, preferably light colored band, or single or multiple shapes (FIG. 16) such as ovals, circles, diamonds, hexagons, or combinations thereof. For more accurate aim, an elongated Sight Line is provided with or without the Sighting Field. This can be a solid line of contrasting color of 1 mm to 40 mm width down the center of the Sighting Field through the intended putterface strike point. Alternatively, the Sight Line can be multiple dots or sharp points on one or more of the above referenced shapes creating the Sighting Field (FIG. 16). Shapes with sharp centerline points (diamonds, arrows, hexagons) are preferable to rounded objects (circles or ovals), which later shapes preferably have a solid or dotted Sight Line through them to assist aim.

The Sight Line length can be extended by placing dots, dashes, or stripes, preferably of the same color or width, on the golf ball and aiming these ball Sight Line extensions at the target when marking and replacing the ball on the putting green. These ball markings are permitted under USGA rules.

BRIEF DESCRIPTION OF THE DRAWINGS

All drawing figures except FIG. 18 are planar views. Putter head height or elevation typically ranges from 1.5 to 6.5 cm.

DESCRIPTION OF THE PREFERRED EMBODIMENTS

FIGS. 1 through 5 are simplified idealized labeled and dimensioned drawings for the purpose of comparing prior art high MOIP putter designs with the present invention. These figures and the related MOIP comparisons were previously discussed.

Figure 1:
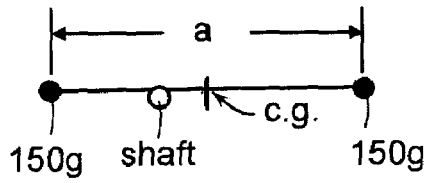
Prior Art FIG. 1
FIGS. 1 and 2 are simplified planar views of transverse bi-polar and axial bi-polar weighted putterheads (prior art), respectively, used to compute theoretical maximum MOICH.
Figure 2:
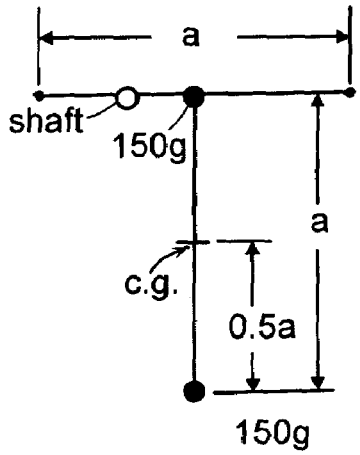
Prior Art FIG. 2
Figure 3:
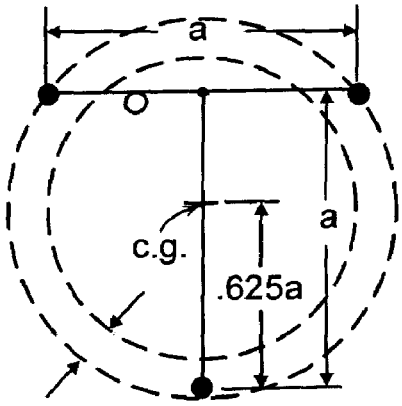
FIGS. 3 and 4 are simplified planar views of tri-polar and multi-polar Mass Ring weighted putterheads, respectively, of the present invention used to compute theoretical maximum MOICH.
Figure 4:
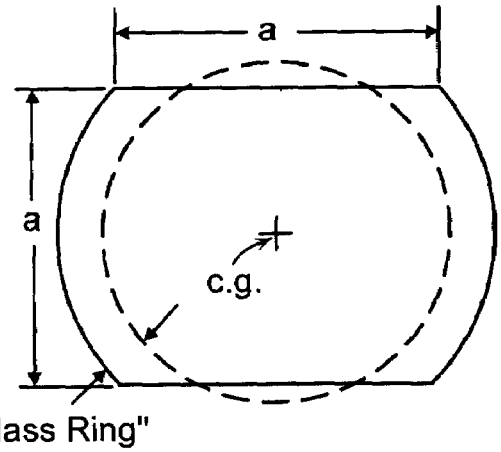
Figure 5:
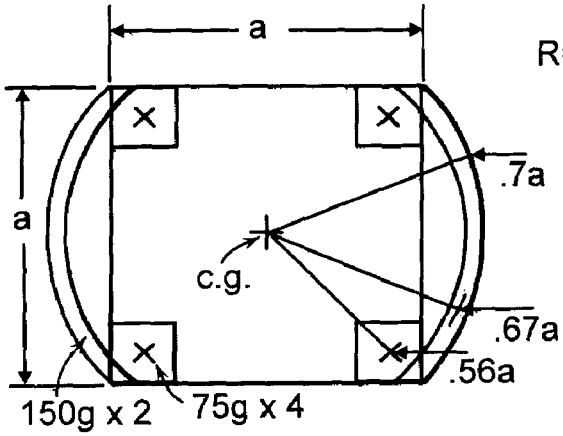
FIG. 5 is a simplified planar section of a prior art putterhead (Long '958) with a putterhead of the present invention of identical facewidth superimposed over it to show the difference in r (radius of gyration) and, therefore, MOICH and MOIP.
Figure 6:
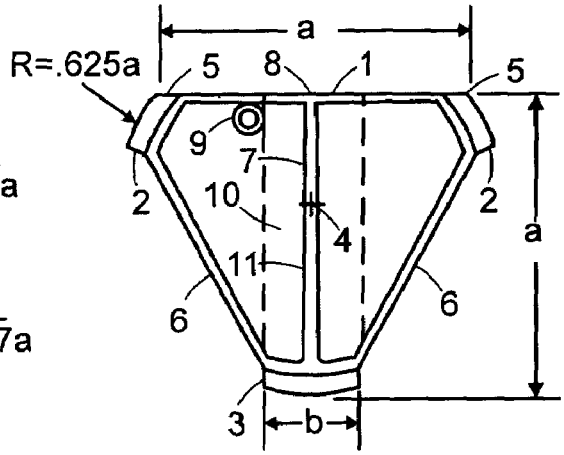
FIGS. 6 and 7 are planar views of tri-polar weighted Mass Ring putterheads of the present invention with rigid open spaceframes.

FIG. 6 is a 3 circular section (tri-polar) Mass Ring weighted putterhead of the present invention with strike face 1 width "a" equal to front to rear depth "a." The circular section toe and heel weights 2 preferably of a material heavier than steel, such as brass, copper, lead, or tungsten are slightly smaller and lighter than the rear weight 3 of similar material such that all three weights are equidistant from the clubhead center of mass 4. The front ends 5 of the toe and heel weights 2 form the extreme toe and heel sections of the strikeface putterface 1. The distance from the center of mass 4 to 5 is approximately the same as the distance to the extremity of the rear weight 3 and equals about 0.625×a. The three weights are in rigid solid communication with each other and the central area of the strikeface 1 via two lateral truss members 6 and one central truss member 7. Rigidity is enhanced by the triangular configuration of truss members 1, 6, and 7. MOIP is increased significantly beyond MOICH by placing the shaft axis 8 at or near the faceplate intended central strike point 8. The shaft mount or hosel 9 is slightly remote from the shaft axis 8 via use of an offset (bent) putter shaft or hosel. This prevents the shaft from visually interfering with the permanent, integral or removable Sighting Field 10 and Sight Line 11. If the Sighting Field 10 is located below the central truss member 7, it can also serve as a putter bottom or sole plate. The Sighting Field is approximately the width of a golf ball (b) and preferably white, bright, or light in color to allow optical axial combination with a golf ball in front of, and close to, the intended strike point 8. The Sighting Field can be made of either durable plastic or plastic composite, or thin, but hard, metal (to keep weight down yet prevent club damage). Most of the clubhead mass, preferably over 70%, is located within the Mass Ring which is concentric with the center of mass, and preferably between r and 0.7 r or 70% of r, the maximum distance from the center of mass to any clubhead extremity. This creates extremely high MOICH in a rigid solid putterhead.

Figure 7:
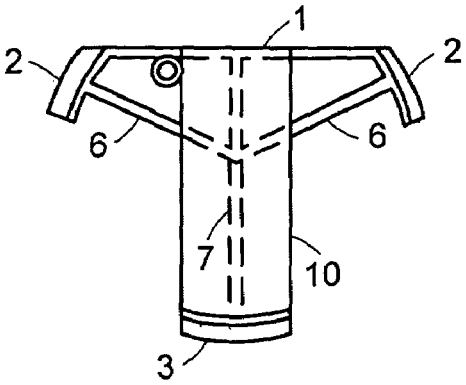

FIG. 7 is a 3 circular section Mass Ring weighted putterhead of the present invention similar to FIG. 6, but using side truss members 6 which are shorter (hence lighter) than FIG. 6, and a central truss member 7 which is thicker or tubular in section to prevent unwanted vibration in the rear section of 7.

In all embodiments of the present invention, the truss members can be verticle thin metal or composite strips, or other sectional shapes such as L, T, I, I, U, or tubular. The Sighting Field with Sight Line 10 can be plastic or metal, flat or cylindrical, structurally integrated into the frame (acting as a structural member) or attached to the frame without structural function.

Figure 8:
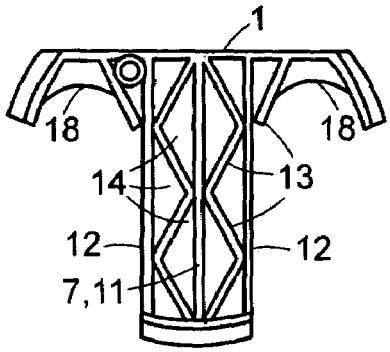
FIGS. 8 is a planar view of a tri-polar weighted Mass Ring putterhead of the present invention with interior rigid open spaceframe made of triangular cell honeycomb.

FIG. 8 is a 3 circular section Mass Ring weighted putterhead of the present invention, similar to FIGS. 6 and 7, but using large cell triangular honeycomb to create a rigid light high open area truss system comprised of axial members 7 and 12 plus angled members 13. The exterior axial members 12 also define the Sighting Field being approximately golf ball width apart, and the central axial member 7 can also serve as the Sight Line 11. The area between structural members within the Sighting Field can be open (allowing grass under the putterhead to be visible) or it can have a plastic or metal bottomplate approximately Sighting Field width.

Figure 9:
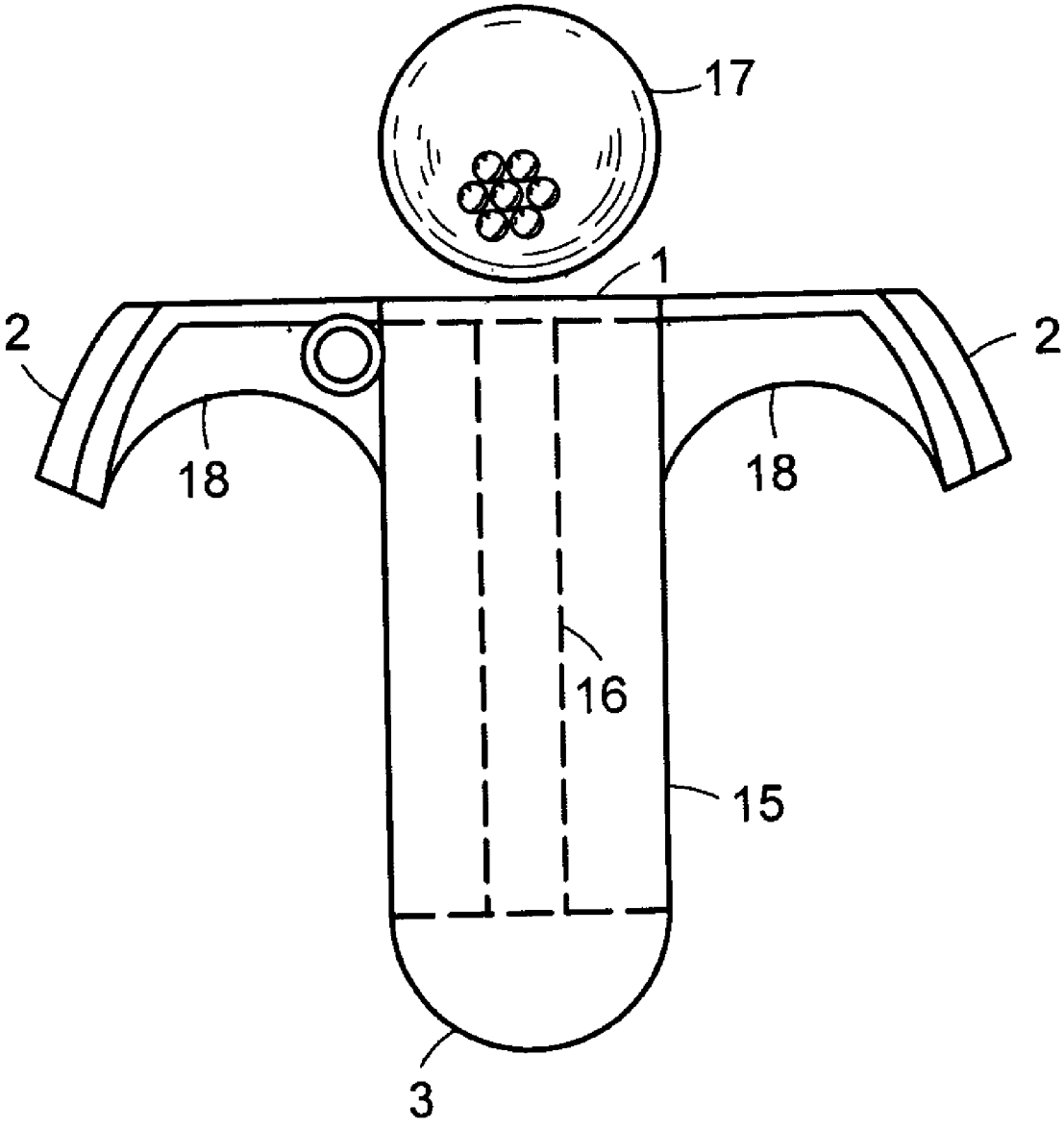
FIG. 9 is a planar view of a tri-polar weighted Mass Ring putterhead of the present invention with cylindrical axial oriented body.

FIG. 9 is a 3 circular section Mass Ring weighted putterhead of the present invention similar to FIGS. 6, 7, and 8 except for a metal, plastic or composite tubular body 15 approximately the diameter of a golf ball which can serve as a structural or non-structural member of the internal frame. If it is non-structural, an internal rigid member 16 can form the necessary rigid connection between the rear weight 3 and the central portion of the strikeface 1. The rear weight 3 is spherical in this embodiment to better match the front end of the Sighting Field which is the ball 17 to be struck. The lateral weights 2 are rigidly connected to the frame via the strikeface 1 and horizontal arched sections 18 or vertical truss members previously described.

Figure 10:
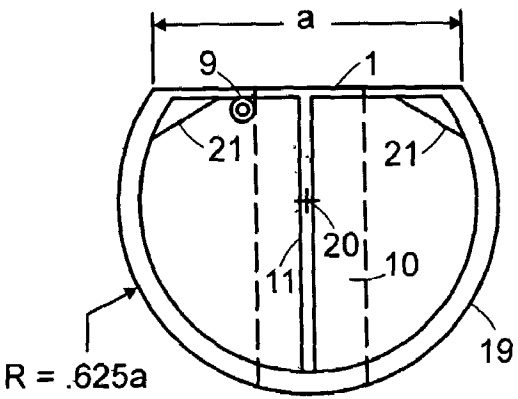
FIG. 10 is a planar view of a circular section multi-polar Mass Ring weighted putterhead of the present invention with central frame member.

FIG. 10 is a large continuous circular section Mass Ring weighted putterhead of the present invention. The continuous section Mass Ring 19 spans approximately 255° of a full circle being intersected in the front by the strikeface 1, where the facewidth is very slightly larger than the front to rear depth. To maintain the center of mass approximately concentric with the center of ring section 20, supplemental weighing 21 is added or alternatively a heavier or thicker faceplate 1 is used.

This configuration illustrates one of the attractive features of Mass Ring weighted putters of the present invention, namely they can use conventional materials like aluminum or steel and still achieve MOICH and MOIP two or more times higher than popular "high moment of inertia putters" which use more exotic and expensive weights of lead or tungsten. A 12.7 cm facewidth putter of FIG. 10 configuration could use an aluminum Mass Ring section of 1.27 cm thickness by 2.54 cm depth. Steel would require only 0.34 cm ring thickness. FIG. 10 shows an optional detachable Sighting Field 10. The central stiffening member 11 can also serve as the Sight Line.

Figure 11:
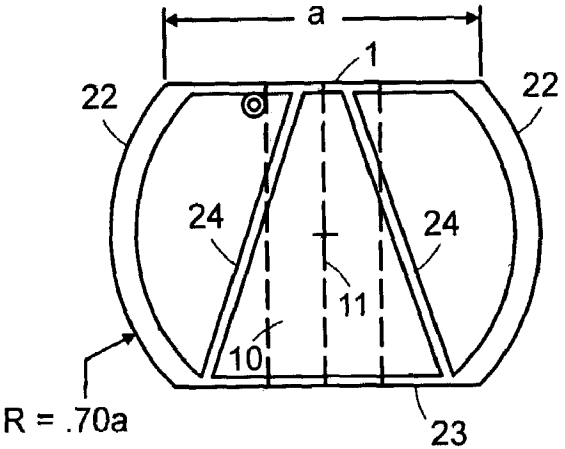

FIG. 11 is a 2 circular section Mass Ring weighted putterhead of the present invention. The 2 weighted circular sections 22, containing most of the putterhead mass, have a larger radius of gyration (approximately 0.7a vs 0.625a) than the putterheads of FIGS. 6–10 creating a planar moment of inertia 25.4% larger than the 3 circular section weighted Mass Rings of the present invention previously described (with the same facewidth "a"). Putterheads of the present invention of face width "a", and depth "a" having four or more Mass Ring located weigh locations and a rear face 23 parallel to and approximately equal in dimension "a" to the putterface 1 will always have higher MOICH than the 3 weighted putterhead FIGS. 6–9 or the circular backed putter of FIG. 10. The triangular orientation of frame members 24 and the arched shape of weight members 22 provide the required rigid connections between weights 22, putterface 1 and hosel 9. An optional, detachable Sight Field with Sight Line 10, is also shown.

Figure 12:
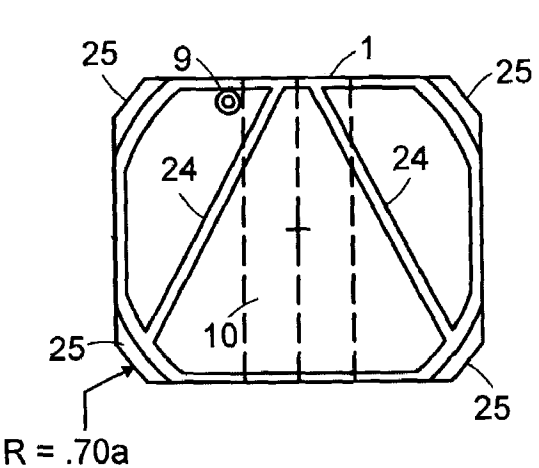
FIGS. 11 and 12 are planar views of 2 and 4 section Mass Ring weighted putterheads, respectively, of the present invention with space frames and Sighting Fields.

FIG. 12 is a 4 circular section Mass Ring weighted putterhead of the present invention similar to FIG. 11 except for the 4 vs 2 weighted Mass Ring sections 25. It also enjoys the higher radius of gyration (r≈0.7a) and therefore higher MOICH of FIG. 11.

Figure 13:
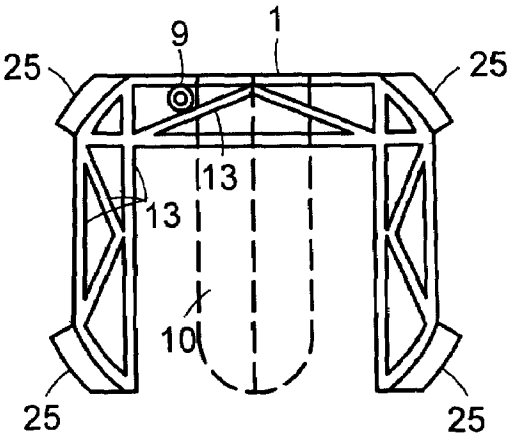
FIG. 13 is a planar view of a 4 section Mass Ring weighted putterhead of the present invention with triangular honeycomb spaceframe and replaceable Sighting Field with Sight Line.
Figure 16A:
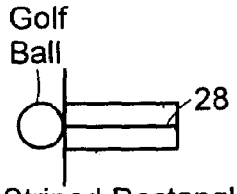
FIG. 16 shows multiple examples of Sighting Fields with striped or integral Sight Lines of the present invention which may be permanently, integrally, or removably attached to the Mass Ring weighted putters of the present invention.
Figure 16B:
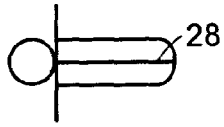
Figure 16C:
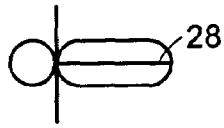
Figure 16D:
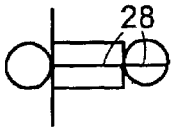
Figure 16E:
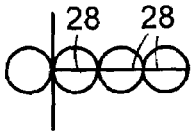
Figure 16F:
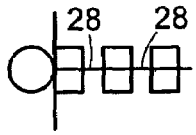
Figure 16G:
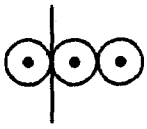
Figure 16H:
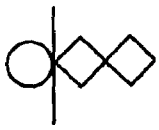
Figure 16I:
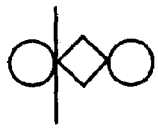
Figure 16J:
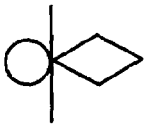
Figure 16K:
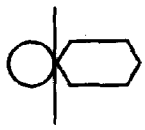
Figure 16L:
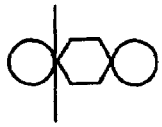
Figure 16M:
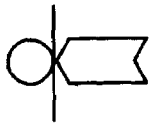

FIG. 13 is a 4 circular section Mass Ring weighted putterhead of the present invention similar to FIG. 12 except that the 4 weights 25 are rigidly connected to each other, the faceplate 1, and the hosel 9, by large triangle honeycomb open truss system members 13, similar to FIG. 8.

Figure 15:
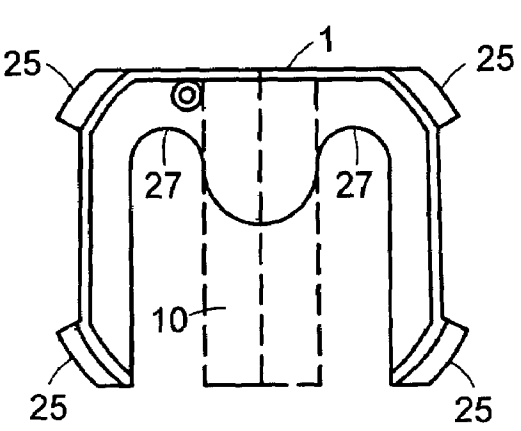
FIG. 15 is a planar view of a 4 section Mass Ring weighted putterhead of the present invention with 2 "T" section or "L" section axial frames and removable Sighting Field with Sight Line.
Figure 14:
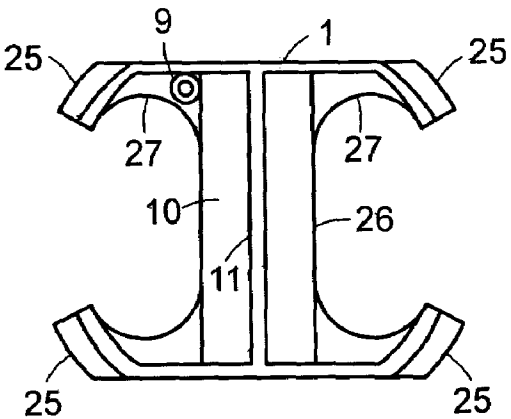
FIG. 14 is a planar view of a 4 section Mass Ring weighted putterhead of the present invention with axial "T" section central frame and arched lateral stiffeners.

FIGS. 14 and 15 are 4 circular section 25 Mass Ring weighted putterheads of the present invention similar to FIGS. 12 and 13, except that the open frame truss system has been replaced via either a central axial "T" shaped frame member 26 (FIG. 14), or 2 axial "T" or "L" shaped frame members (FIG. 15) with horizontal arches 27 providing the required rigid connection to weights 25. The Sighting Field and Sight Line is either integral with the structural frame (FIG. 14) or detachable (FIG. 15).

FIG. 16 provides 13 examples of Sighting Field shapes with Sight Lines. Shapes a through f have no definitive or integral multiple sharp axially aligned points through the putterhead strikepoint, so a dark or contrasting color (with Sight Field) Sight Line 28 bisects the shapes. Shapes g through m do have sharp axial aligned central aim points forming an integral Sight Line. Any of these shapes, or combinations thereof, can be integrally incorporated into the putters of the present invention or removably attached thereto.

Figure 17:
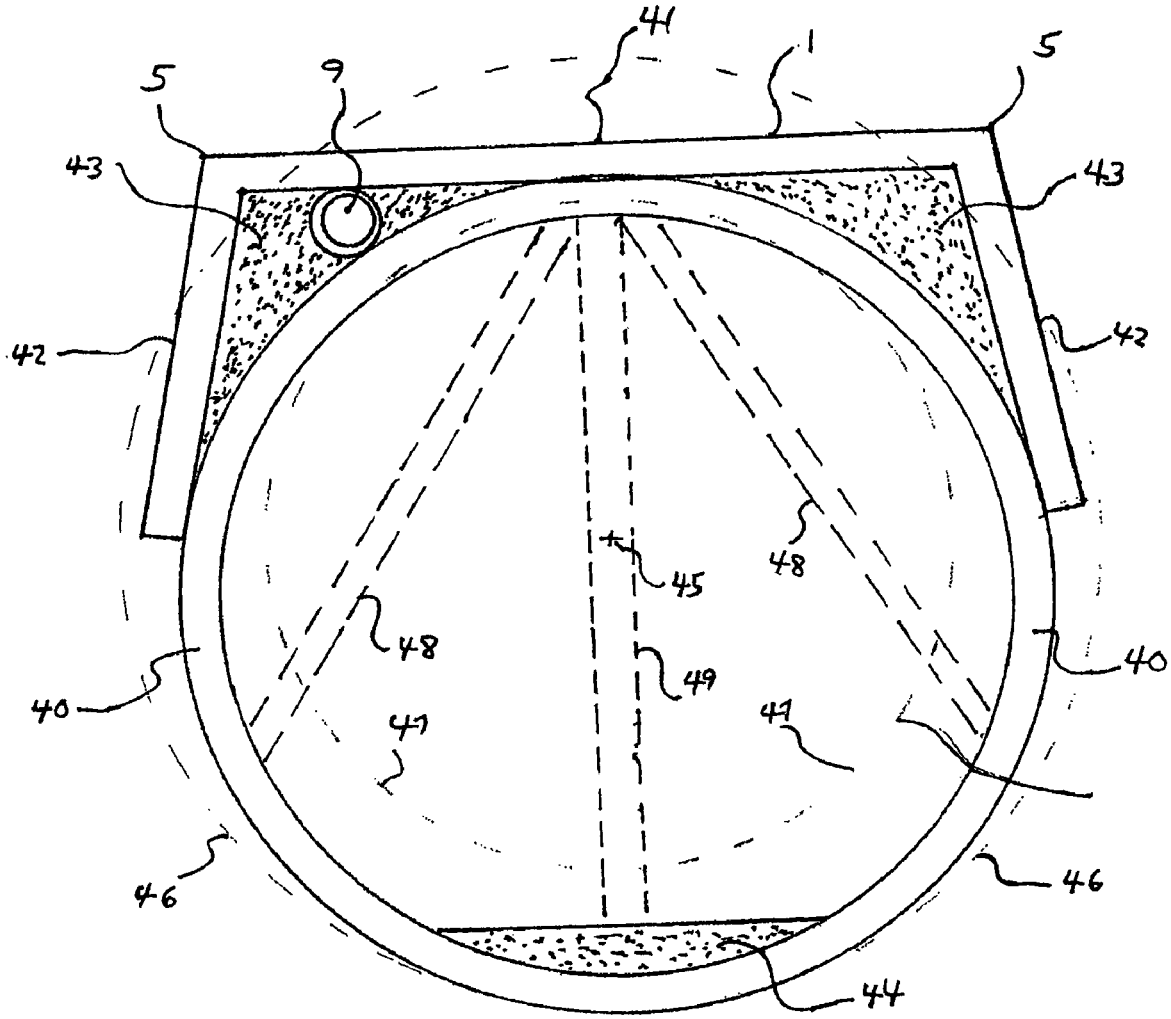
FIG. 17 shows a strikeface tangentially attached to a ring shaped primary frame with optional internal stiffener members and optional supplemental weighting mass.
Figure 18:
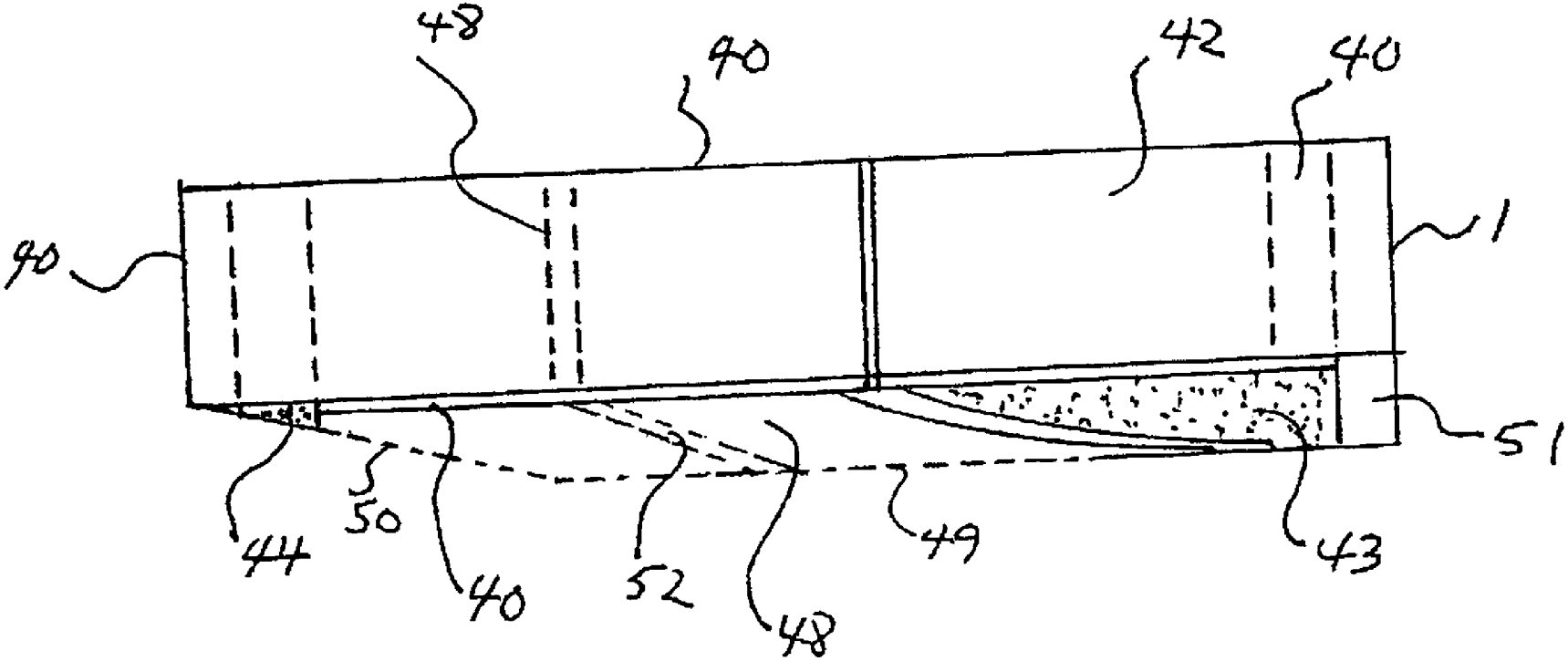
FIG. 18 is an elevation view of the putterhead of FIG. 17.

FIGS. 17 and 18 show an arcuate shaped putterhead of the present invention comprising a continuous circular ring section 40 tangentially connected to the strikeface 1 behind the intended strikeface contact point 41. The strikeface 1 can be smaller than (shown) or long than (not shown) the ring 40 outside diameter. The toe 5 and heal 5 ends of the strikeface can be further supported or rigidized by short structural members 42 connected to the ring 40. While the entire ring 40 can provide most of the Mass Ring weighting means, supplemental front 43 and rear 44 weights about the ring 40 can be used. Even where no front weights are used, some rear weight 44 or rear thickening (not shown) of the ring is desirable to offset the weight of the strikeface 1 and the strikeface support members 42 thus keeping most of the putterhead mass approximately equidistant from the putterhead planar center of gravity 45 and with the Mass Ring having an outside diameter indicated by dotted circle 46 and an inside diameter 70% of the outside diameter shown as 47. If the front weights 43 are not used, this void can be filled with solid fill. Sharp corners like 5 shown may be outside the Mass Ring outside diameter 46 because such corners contain a very small fraction of total putterhead mass. Where the ring 40 which can be of solid (shown) or composite construction (not shown) does not provide sufficient rigidity to avoid undesirable sustained ball impact vibration or noise, optional stiffening struts 48 (dotted) can be used. An optional Sight Line 49 (dotted) can also serve as a stiffening strut.

FIG. 18 shows an elevation view of the putterhead of FIG. 17. The optional Sight Line strut 49 is beveled at the rear 50 to avoid ground interference when striking a golf ball. The strike face member 1 is beveled at toe 51 and heel (not shown) to avoid toe or heel ground interference, especially on sloping greens. The optional stiffening struts 48 are also beveled 52 at toe and heel for the same reasons.

The preceding drawings and descriptions present various embodiments of the present invention. Variations of these descriptions utilizing the same principles described, remain within the scope of the present invention.

The invention claimed is:

1. A golf putter comprising a shaft and a putterhead connected to said shaft at a connection point, said putterhead having a center of mass and a strikeface, said putterhead including weighting means defining a mass that comprises at least 70% of total putterhead mass, said weighting means being positioned at continuous or discontinuous locations within a planar, circular Mass Ring, a vertically oriented hollow cylinder approximately concentric with said center of mass, said Mass Ring having an outside diameter that is approximately coincident with the extreme planar dimensions of said putterhead and an inside diameter which is at least 70% of said outside diameter, wherein said weighting means comprises one or more weight elements, a majority of said weight elements having a planar length greater than a planar width and being oriented such that said length is generally normal to a line extending radially outward from said putterhead center of mass, allowing said majority of said weight elements to be located within said Mass Ring, said putterhead further comprising at least one structural member connected to a central portion of said strikeface for establishing solid rigid communication between said weighting means, said central portion and said connection point.

2. The putter of claim 1 wherein the putterhead facewidth is between 8 and 18 cm, and the putterhead mass is between 220 and 550 gms.

3. The putter of claim 1 or 2 where the shaft axis is at least 2 cm, but less than 10 cm in front of the putterhead planar center of mass.

4. The putter of claim 1 where the at least one structural member is a light weight rigid high planar open area frame or truss of cast or fabricated thin section truss members of T, L, I, l, or tubular sections, or combinations thereof.

5. The putter of claim 4 wherein the lightweight open rigid frame is made of aluminum, titanium, steel or stainless steel, ceramic, fiber reinforced composites, or combinations thereof, with a specific gravity at or below that of steel or stainless steel.

6. The putter of claims 4 or 5 wherein the light weight open rigid frame is made of predominantly open cell honeycomb of predominantly triangular cells.

7. The putter of claims 4 or 5 where said weighting means is of a material with a specific gravity at or above that of steel or stainless steel.

8. The putter of claims 1 or 4 with an elongated Sighting Field at least ⅔ of putterface width with Sight Line transverse to the putter face approximately centered on the intended strikepoint such Sighting Field having a width between 3.5 cm and 5.1 cm and such Sighting Field being comprised of one or more white, bright or, light, or reflective colored shapes consisting of stripes, circles, arrows, ovals, rectangles, diamonds, or hexagons with convex or concave rounded or pointed ends or combinations thereof, such Sight Line centrally located on such Sighting Field being either a central contrasting color narrow stripe of less than 1 cm width or multiple points centrally located within the above shapes comprising said Sighting Field.

9. The putter of claim 8 wherein those portions of the putterhead lying outside the Sighting Field or Sight Line have a high planar open area, exceeding 65%, allowing the putting green to show through such openings thus enhancing focus and visibility of the axial Sighting Field or Sight Line.

10. The putter of claim 8 wherein the Sighting Field or Sight Line is detachable or interchangeable from the faceplate and frame accommodating individual player preferences.

11. The putter of claim 10 wherein the Sighting Field or Sight Line can be angularly adjusted by plus or minus 6° to accommodate alignment or stroking tendencies of individual players.

12. The putter of claim 8 wherein central portions of the rigid frame also serve as the Sighting Field or Sight Line.

13. The putter of claim 8 and golf ball wherein the Sight Line marking on the putterhead matches a partial or full circumference stripe, logo, or solid block lettering on the ball provided by player, manufacturer, or others, such ball being aimed by the player toward the intended target thereby further extending the effective Sight Line.

14. The golf putter of claim 1 wherein said majority of said weight elements are arcuate in shape.

15. The putter of claim 1 with an elongated Sight Line at least 75% of putterface width transverse to the putterface approximately centered on the intended strikepoint having a width of less than 1 cm.

16. The putter of claim 1 where those portions of the putterhead lying outside the Sighting Field or Sight Line are dark, or non-reflective, or contrasting in color to the Sighting Field or Sight Line enhancing focus and visibility of the axial Sighting Field or Sight Line.

* * * * *